US010982462B2

(12) United States Patent
Olsen

(10) Patent No.: US 10,982,462 B2
(45) Date of Patent: Apr. 20, 2021

(54) PORTABLE WINDSCREEN

(71) Applicant: Mark Olsen, Yarmouth, ME (US)

(72) Inventor: Mark Olsen, Yarmouth, ME (US)

( * ) Notice: Subject to any disclaimer, the term of this patent is extended or adjusted under 35 U.S.C. 154(b) by 0 days.

(21) Appl. No.: 15/955,131

(22) Filed: Apr. 17, 2018

(65) Prior Publication Data

US 2018/0298630 A1 Oct. 18, 2018

Related U.S. Application Data

(60) Provisional application No. 62/486,710, filed on Apr. 18, 2017.

(51) Int. Cl.

| | |
|---|---|
| ***E04H 15/06*** | (2006.01) |
| ***E04H 15/00*** | (2006.01) |
| ***E04H 15/64*** | (2006.01) |
| ***E04H 15/60*** | (2006.01) |
| ***E04H 15/26*** | (2006.01) |

(52) U.S. Cl.

CPC ..... *E04H 15/001* (2013.01); *E04H 15/06* (2013.01); *E04H 15/26* (2013.01); *E04H 15/60* (2013.01); *E04H 15/64* (2013.01)

(58) Field of Classification Search

CPC ..... E04H 15/06; E04H 15/001; E04H 15/64; E04H 15/58; E04H 15/26; E04H 15/32; E04H 15/60; B60J 11/04; B60J 11/08; B60J 1/20

USPC ... 135/88.01, 88.03–88.05, 88.07–88.09, 96, 135/99, 114–115, 117–119, 120.4, 901, 135/905; 296/95.1, 136.01, 136.1, 296/136.11, 136.12; 280/770; 150/166

See application file for complete search history.

(56) References Cited

U.S. PATENT DOCUMENTS 1,751,518 A * 3/1930 Maclean ..... E04H 15/06 135/147
3,599,740 A * 8/1971 Martinmaas ..... B62M 27/02 180/190
4,098,536 A * 7/1978 Mills ..... B60J 11/00 135/117
4,114,633 A * 9/1978 Herbez ..... E04H 15/06 135/97
5,014,805 A * 5/1991 Uchida ..... B62M 27/02 180/184
5,458,390 A * 10/1995 Gilbert ..... B62J 17/00 296/78.1
5,562,139 A * 10/1996 Cseri ..... B62J 19/00 150/167
5,641,192 A * 6/1997 Smith ..... B60J 7/102 135/117
5,720,312 A 2/1998 Scheuermann
5,752,736 A * 5/1998 Nodier ..... B60J 7/102 135/88.15
5,845,958 A * 12/1998 Rudys ..... B60J 11/00 296/136.08
5,915,399 A * 6/1999 Yang ..... B60J 11/00 135/119
5,941,593 A * 8/1999 McCann ..... B60J 11/02 296/136.1
5,954,076 A * 9/1999 McGinnis ..... E04H 15/06 135/88.06

(Continued)

*Primary Examiner* — Noah Chandler Hawk

(74) *Attorney, Agent, or Firm* — Jeffrey Joyce, Esq.

(57) ABSTRACT

An easily portable and quick to assemble and disassemble windscreen for use with a vehicle such as a snowmobile or all-terrain vehicle.

18 Claims, 6 Drawing Sheets

(56) References Cited

U.S. PATENT DOCUMENTS 6,030,026 A * 2/2000 Vega ..... B60P 3/341 135/88.13
6,070,629 A * 6/2000 Whiteside ..... B60J 11/00 150/166
6,276,381 B1 * 8/2001 O'Brien ..... B60J 11/02 135/115
6,308,653 B1 * 10/2001 Geraci ..... B63B 17/02 114/361
6,394,528 B2 * 5/2002 Hoenack ..... B60J 11/00 150/160
6,516,822 B2 2/2003 Schlier
6,565,139 B2 * 5/2003 Bayerle ..... B60J 11/00 296/77.1
6,802,327 B2 10/2004 Koss
6,910,492 B1 * 6/2005 Stuck ..... E04H 15/06 135/88.08
6,962,221 B1 11/2005 Carrette
6,964,448 B2 * 11/2005 Morin ..... B60J 11/00 150/166
7,137,660 B2 * 11/2006 Weddington ..... A45B 23/00 296/105
7,182,391 B2 * 2/2007 Thrasher ..... B60J 11/00 296/136.02
7,647,879 B2 * 1/2010 del Valle Bravo ..... B63B 17/02 114/361
8,584,276 B1 * 11/2013 Wilson ..... B62J 11/00 5/118
8,764,097 B2 * 7/2014 Fournier ..... B60J 11/04 296/136.01
8,764,098 B2 * 7/2014 Markley ..... B60J 11/04 296/136.07
2003/0098108 A1 * 5/2003 Littlefield ..... A45F 4/02 150/106
2009/0167049 A1 * 7/2009 Lariviere ..... B60J 11/02 296/98
2017/0050505 A1 * 2/2017 Yu ..... B60J 11/04

* cited by examiner

PORTABLE WINDSCREEN

BACKGROUND INFORMATION

Field of the Invention

The invention relates to windscreens, particularly those for use with outdoor sports and activities.

Discussion of Prior Art

Many outdoor sports and activities, such as fishing, hunting, and gardening, frequently require a person to sit or crouch in a certain location while participating in the activity. Ice fishing, for instance, often involves sitting on a lake for an extended period of time while a fisherman waits to catch fish. The weather, and in particular the wind, is often an obstacle in the participants enjoyment of these types of activities.

That is particularly true with ice fishing as lakes in the winter are frequently subject to harsh winds. To enjoy ice fishing on windy winter days the sporting goods industry has created a number of huts and hut-like structures that are intended to shield a user from the weather. However, all are cumbersome to transport, to setup and to tear down.

What is needed, therefore, is an easily portable and easily assembled and disassembled windscreen.

BRIEF SUMMARY OF THE INVENTION

The invention is a portable windscreen that easily attaches to a support vehicle and shields the user from the wind when in use and that is easily transported when not in use. The windscreen generally includes a shield that is a relatively rugged sheet of material, the shield being supported by one or more support posts and secured to the support vehicle using one or more securing means. When not in use the shield and securing means are easily wrapped around the support post for compact transport. To assemble the windscreen the shield is simply unwrapped, the support post mounted and the securing means attached to the vehicle.

The support vehicle may be, for example, a snowmobile or an all-terrain vehicle. The shield may come in a variety of shapes, for example, a shield that is relatively triangular in shape is particularly well suited for use with a snowmobile or all-terrain vehicle. In this example, a single support post may be used near the mid-point of the shield to hold the triangular shape, with the securing means attaching the ends of the shield to the front and rear of the support vehicle.

When properly attached to the support vehicle the windscreen effectively attaches to one side of the support vehicle, allowing the user to sit on the vehicles seat while being shielded from the wind. The user is then able to enjoy his/her activity, such as ice fishing on a windy lake.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
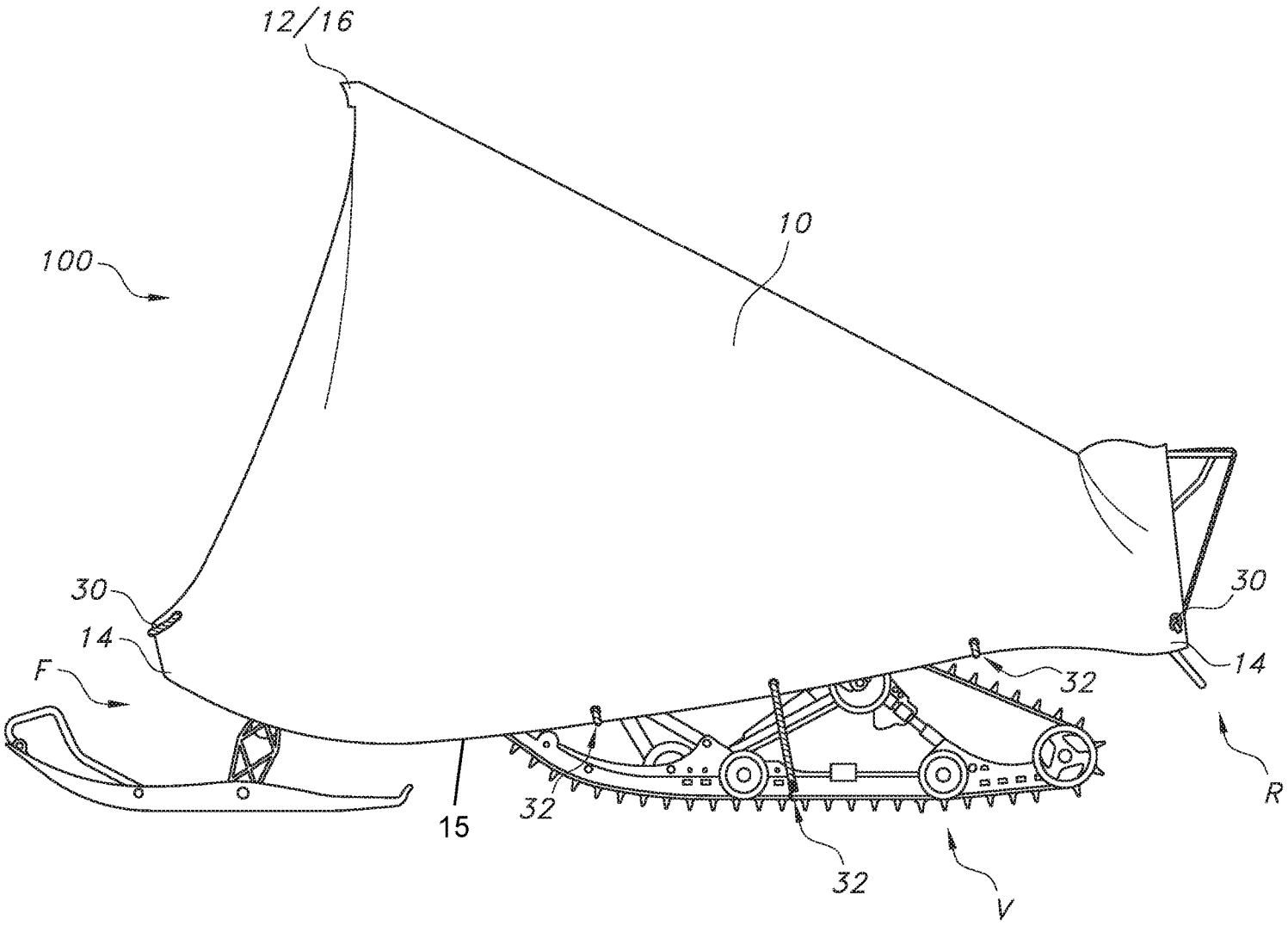
FIG. 1 is a side view of the portable windscreen according to an embodiment of the invention in a fully assembled state and attached to a snowmobile, showing the shield-side of the portable windscreen.
Figure 2:
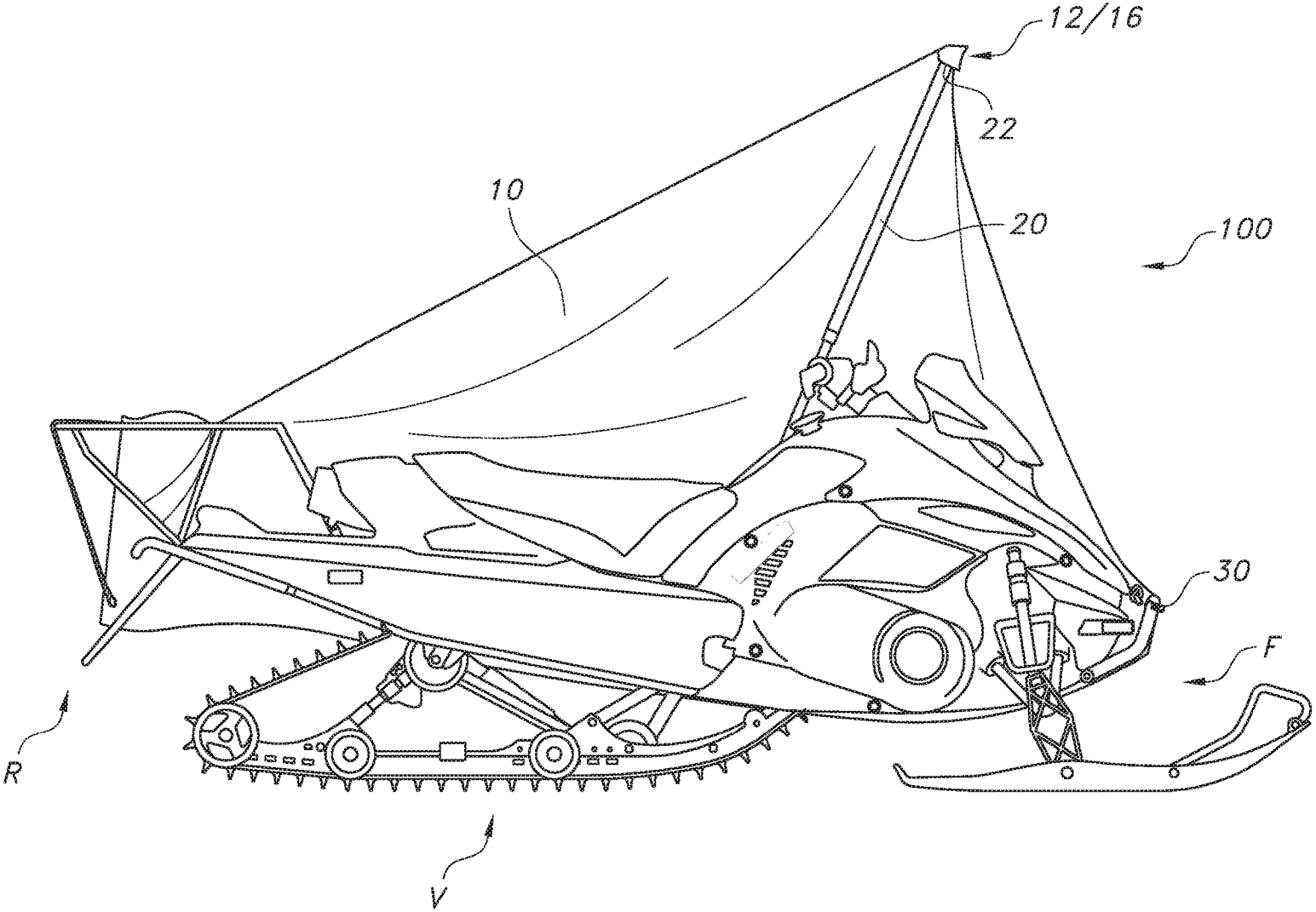
FIG. 2 is a side view of the device attached to a snowmobile, showing the user side of the device.

FIGS. 1 and 2 illustrate the portable windscreen 100 according to the invention attached to a support vehicle V. At times the disclosure discusses the support vehicle V as a snowmobile, however, it is understood that snowmobiles are only used as an illustrative example and that the portable windscreen 100 may be used with other types of vehicles and is in no way limited to use with a snowmobile.

Figure 6:
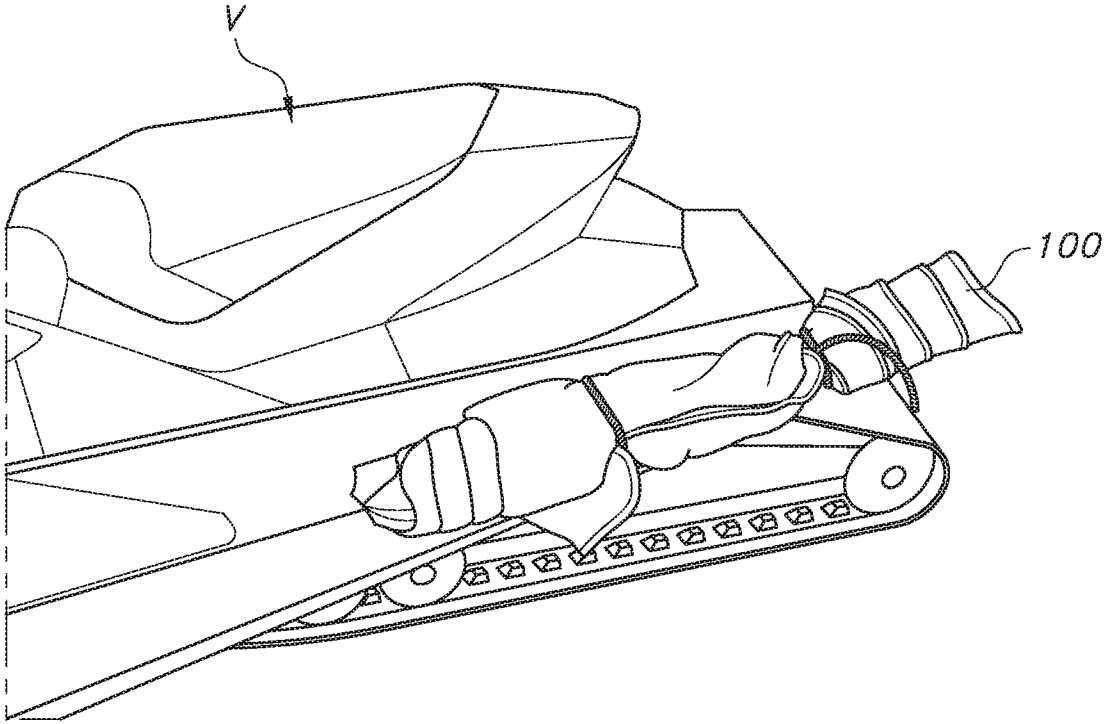
FIG. 6 shows the portable windscreen in a collapsed and transportable configuration attached to the side of a snowmobile for transport.

The portable windscreen 100 includes a shield 10, at least one support post 20 and securing means 30. When fully assembled the support post 20 supports the shield 10 in the vertical plane and the securing means 30 attach the shield 10 to the support vehicle V for support in the horizontal plane. When in a collapsed position for transport or storage the shield 10 is typically wrapped around the support post 20 and the securing means 30 may be used to hold the wrapped shield in position, after which the windscreen 100 is easily transported as shown in FIG. 6.

To assemble the portable windscreen 100 from a collapsed and transportable position, the user need only unroll the shield 10, insert the top post end 22 into or onto the shield top 12 while positioning the bottom post end 24 on a lower portion of the support vehicle V or on an adjacent ground surface, and then secure the securing means 30 to the ends of the vehicle V. In all, the process may be completed in very little time, potentially less than one minute for experienced users.

In the embodiment shown, the shield 10 is shaped roughly like a triangle, having a peak, or a shield top, 12, two shield ends 14 and a shield bottom 15. One support post 20 is included that has a top post end 22 and a bottom post end 24. Inserting or attaching the top post end 22 to the shield top 12 and placing the bottom post end 24 on the vehicle V or on an adjacent area of ground surface supports the shield 10 in the vertical plane. The securing means 30 attaches the two shield ends 14 of the shield 10 to the support vehicle V to support the shield 10 in the horizontal plane and further secure the position and strength of the shield 10.

The shield 10 is comprised of a lightweight and rollable but sturdy material. A wide range of materials are acceptable for the shield 10, however, sturdy materials such as a canvas or other closely woven clothes that are made of linen, cotton, and/or other synthetic fibers such as nylon, polyester, aramids and carbon fibers are best. For example, those materials that are used for making sail boats sails and/or heavy-duty tarps are particularly suitable for the shield 10.

The top post end 22 is insertable into an upper securing post receiver 16 in the peak 12 of the shield 10. The upper securing post receiver 16 may be any form of receiver that is suitable for securing the end of a post, such as, for example, a pocket that is made into the fabric as shown in FIG. 1 or a ring that attaches to or inserted/sown into the fabric. The bottom post end 24 is typically inserted into, or onto, the support vehicle V, however the bottom post end 24 may also be placed on a ground surface or it may inserted into a lower securing post receiver (not shown) on the shield that simply holds the shield vertically but does not attach to the support vehicle V or a ground surface.

The securing means 30 may be any suitable securing means, however, elastic cords such as bungee cords are particularly advantageous. Bungee cords in particular customarily have hooks on either ends of an elastic cord that are easily attached to the shield 10 and vehicle V, and are commonly used with both snowmobiles and all-terrain vehicles. The shield ends 14 may have reinforced openings to secure a hook on a bungee cord.

In the embodiment shown, the support vehicle V is a snowmobile. This embodiment is particularly advantageous for ice fishing. To transport the windscreen 100 to the fishing site the shield 10 is wrapped around the support post 20 and securely fastened, either with the securing means 30 or an additional bungee cord or conventional ties (not shown). The disassembled windscreen 100 is then attached to, or held on, the snowmobile and the user rides to the preferred fishing site. The snowmobile is parked in a position perpendicular to the direction of the wind and the collapsed windscreen 100 is untied and assembled on the snowmobile V.

Figure 3:
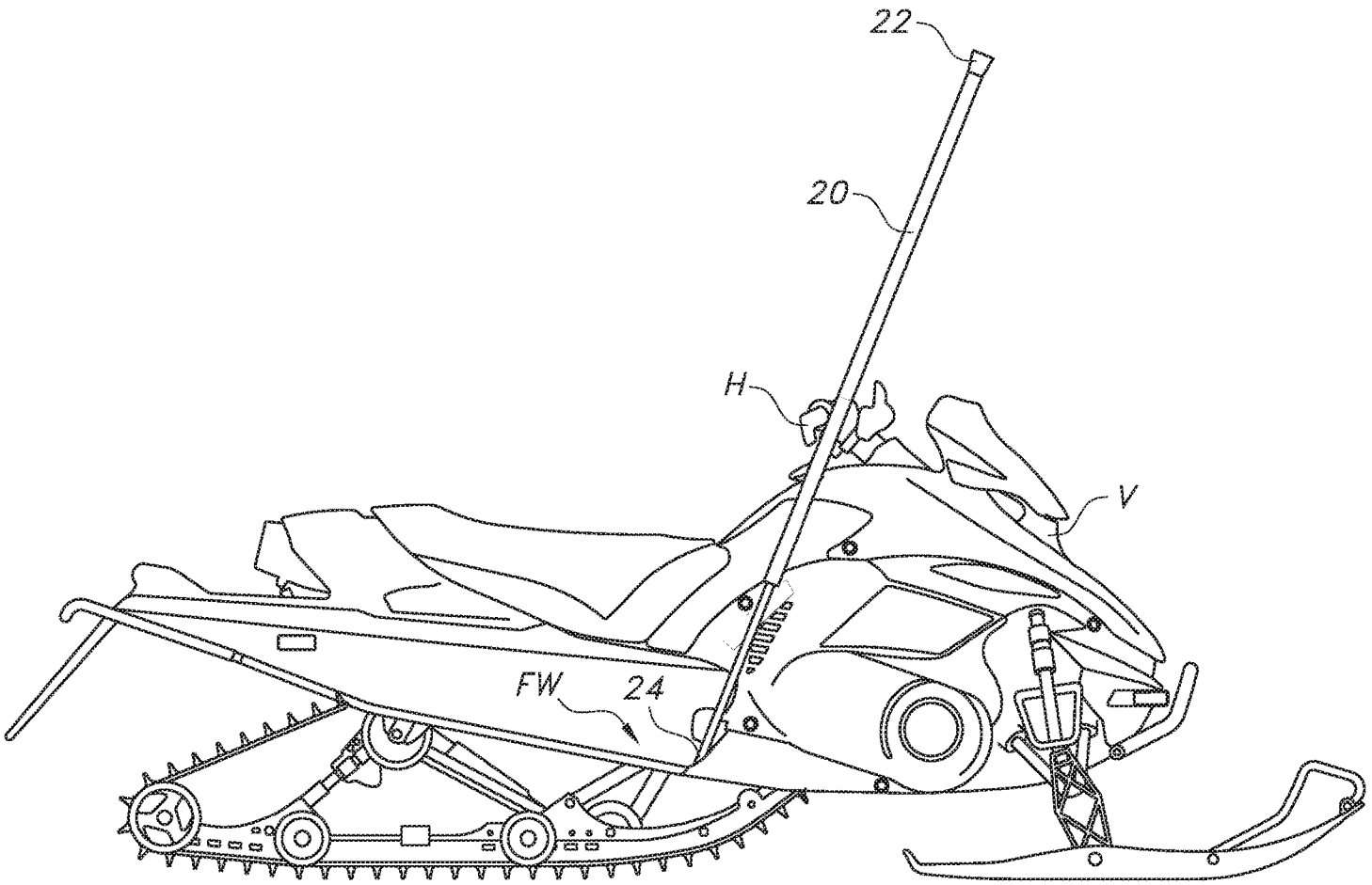
FIG. 3 is a side view of the support post on a snowmobile without the shield.
Figure 4:
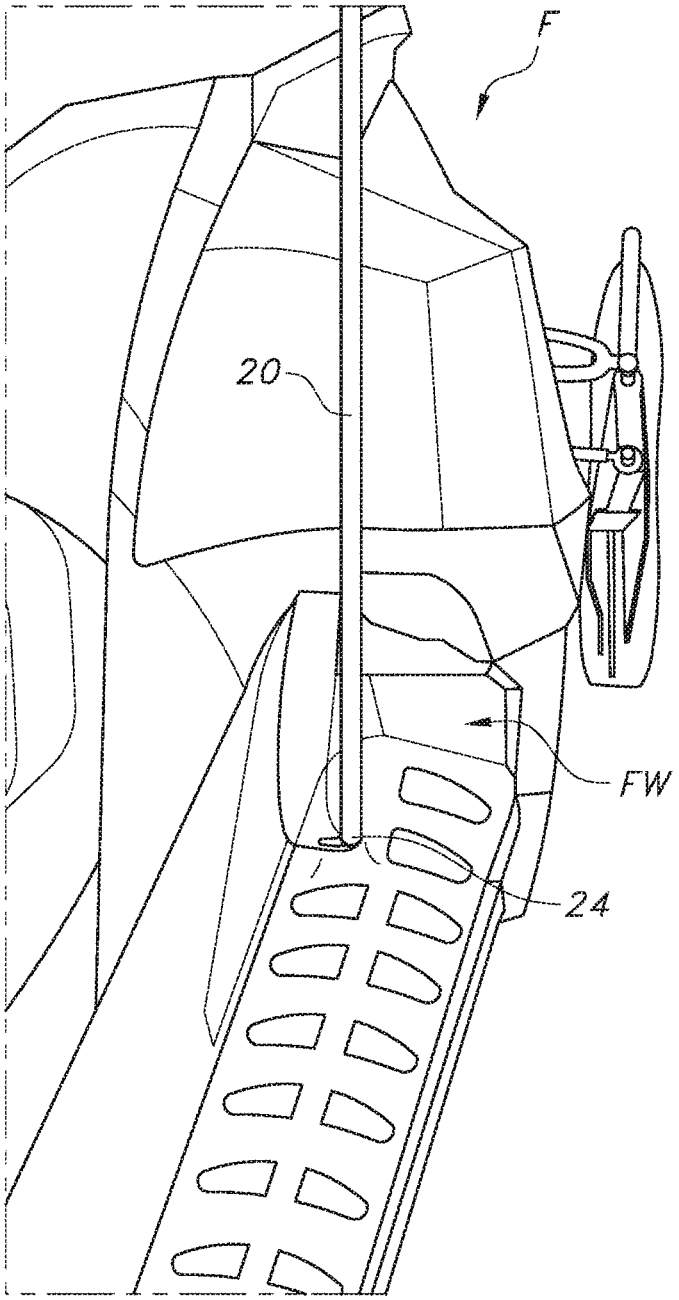
FIG. 4 is a front view of one embodiment of the support post's connection to a support vehicle.
Figure 5:
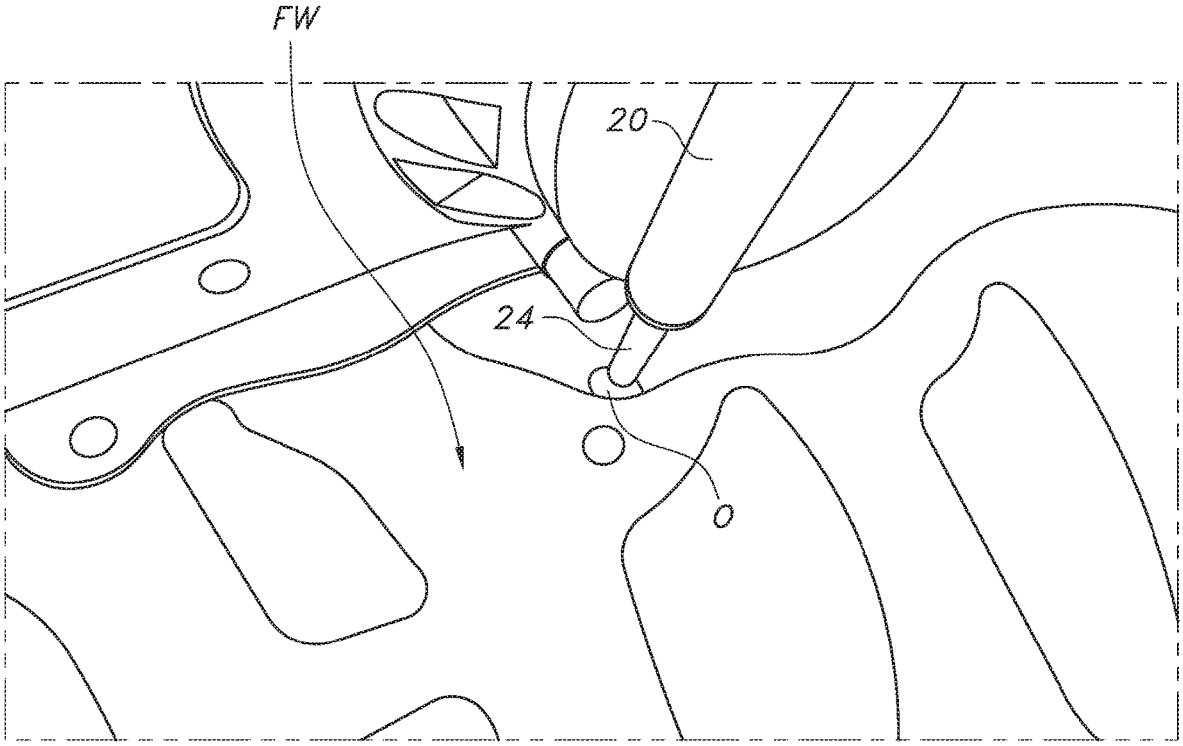
FIG. 5 is a top view of a second embodiment of the support post's connection to the support vehicle.

The top post end 22 of the support post 20 is inserted into the upper securing post receiver 16 and the bottom post end 24 is placed on or in the foot well area on the snowmobiles running boards FW. FIGS. 3-5 illustrate the post 20 in position on the support vehicle V without the shield 10. FIG. 4 illustrates one embodiment of the support post 20 that is designed to sit on the foot well FW and FIG. 5 illustrates a second embodiment of the support post 20 that is designed to fit in an opening O in the foot well FW. The support post 20 may also be secured in position by the snowmobile handlebar H as shown in FIG. 3.

The first securing end 14 is secured to the front F of the snowmobile V by the securing means 30 and the second securing end 14 is secured to the rear R of the snowmobile V by the securing means 30. Additional ties 32 may also be used as shown in FIG. 1 to further secure the shield 10, and in particular the bottom of the shield 10, to the support vehicle V.

After assembling the portable windscreen 100 and securing it to the snowmobile V the user may sit on the snowmobile's seat S and fish while being shielded from the wind. The approximately triangular shape of the shield 10 is advantageous for quick and convenient use, however, other shapes are also suitable. For example, the shield 10 may have an approximately rectangular shape, and additional support posts 20 may be used to fix or hold the shield 10 in different configurations. The additional support posts 20 may be attached to the shield ends 14 extending upward in the vertical direction to support the rectangular shield in the vertical plane, and additional support posts may extend along the top of the shield 10 in the horizontal plane to further secure and support the shape of the shield 10.

It is understood that the embodiments described herein are merely illustrative of the present invention. Variations in the construction of the portable windscreen may be contemplated by one skilled in the art without limiting the intended scope of the invention herein disclosed and as defined by the following claims.

What is claimed is:

1. A portable windscreen adapted to be releaseably attachable to a snowmobile, the portable windscreen comprising:

a shield that is a flat sheet that has a shield top, a shield bottom, and at least a first shield end and a second shield end, the shield top including an upper securing post receiver, and each of the first shield end and second shield end including a securing means;

at least one support post having a top post end and a bottom post end, the top post end being releaseably attachable to or in the upper securing post receiver and the bottom post end of being supportable on a foot well of the snowmobile, the support post supporting the shield in the vertical plane;

wherein the at least one support post is adapted to attach to the shield with the bottom post end of the at least one support post positioned near or on one side of the snowmobile, and the first and second shield ends secured to respective first and second ends of the snowmobile, the shield supported in a substantially vertical plane so as to block wind along only one side of the snowmobile while the other side remains open and accessible to a user.

2. The portable windscreen of claim 1, wherein the top post end of the at least one support post is insertable into the upper securing post receiver.

3. The portable windscreen of claim 1, wherein the securing means is an elastic cord having a hook.

4. The portable windscreen of claim 1, wherein the shield is made of a synthetic fiber.

5. The portable windscreen of claim 1, further comprising one or more ties that are securable to the shield bottom and to the vehicle.

6. The portable windscreen of claim 1, wherein the foot well has an opening and the bottom end of the support post is supportable in the opening.

7. A portable windscreen adapted to be releaseably attachable to a snowmobile, the portable windscreen comprising:

a shield that is a flat sheet that has a shield top, a shield bottom, and at least a first shield end and a second shield end, the shield top including an upper securing post receiver, and each of the first shield end and second shield end including a securing means that is an elastic cord having a hook;

at least one support post having a top post end and a bottom post end, the top post end being releaseably attachable to or in the upper securing post receiver so as to support the shield in the vertical plane;

wherein the at least one support post is adapted to attach to the shield with the bottom post end of the at least one support post positioned near or on one side of the snowmobile, and the first and second shield ends secured to respective first and second ends of the snowmobile, the shield supported in a substantially vertical plane so as to block wind along only one side of the snowmobile while the other side remains open and accessible to a user.

8. The portable windscreen of claim 7, wherein the top post end of the at least one support post is insertable into the upper securing post receiver.

9. The portable windscreen of claim 7, wherein the shield is made of a synthetic fiber.

10. The portable windscreen of claim 7, further comprising one or more ties that are securable to the shield bottom and to the vehicle.

11. The portable windscreen of claim 7, wherein the vehicle has a foot well and the bottom end of the support post is supportable on the foot well.

12. The portable windscreen of claim 11, wherein the foot well has an opening and the bottom end of the support post is supportable in the opening.

13. A portable windscreen adapted to be releaseably attachable to a snowmobile, the portable windscreen comprising:

a shield that is a flat sheet that has a shield top, a shield bottom, and at least a first shield end and a second shield end, the shield top including an upper securing post receiver, and each of the first shield end and second shield end including a securing means;

at least one support post having a top post end and a bottom post end, the top post end being releaseably insertable into the upper securing post receiver so as to support the shield in the vertical plane;

wherein the at least one support post is adapted to attach to the shield with the bottom post end of the at least one support post positioned near or on one side of the snowmobile, and the first and second shield ends secured to respective first and second ends of the snowmobile, the shield supported in a substantially vertical plane so as to block wind along only one side of the snowmobile while the other side remains open and accessible to a user.

14. The portable windscreen of claim 13, wherein the securing means is an elastic cord having a hook.

15. The portable windscreen of claim 13, wherein the shield is made of a synthetic fiber.

16. The portable windscreen of claim 13, further comprising one or more ties that are securable to the shield bottom and to the vehicle.

17. The portable windscreen of claim 13, wherein the vehicle has a foot well and the bottom end of the support post is supportable on the foot well.

18. The portable windscreen of claim 17, wherein the foot well has an opening and the bottom end of the support post is supportable in the opening.

* * * * *